US005601340A

United States Patent [19]

Stout

[11] Patent Number: 5,601,340

[45] Date of Patent: Feb. 11, 1997

[54] READY-TO-ASSEMBLE UPHOLSTERED FURNITURE

[76] Inventor: Max W. Stout, 117 Penny Rd., High Point, N.C. 27260

[21] Appl. No.: 247,015

[22] Filed: May 20, 1994

[51] Int. Cl.[6] ..... A47C 4/02

[52] U.S. Cl. ..... 297/440.16; 403/13; 297/440.21; 297/440.1

[58] Field of Search ..... 297/440.1, 440.14, 297/440.16, 440.21, 440.24, 440.22; 108/53.1, 91; 403/13, 14; 248/150, 224.8

[56] References Cited

U.S. PATENT DOCUMENTS

| | | | |
|---|---|---|---|
| 22,297 | 12/1858 | Lytle et al. . | |
| 479,071 | 7/1892 | Holstein . | |
| 1,695,101 | 12/1928 | Hoffman | 297/440.21 X |
| 2,466,204 | 12/1949 | Brown | 297/440.16 X |
| 3,001,822 | 9/1961 | Pagliaro et al. . | |
| 3,030,146 | 4/1962 | Faxon . | |
| 3,032,375 | 5/1962 | Lalandre | 297/440.24 |
| 3,066,982 | 7/1962 | Brower . | |
| 3,170,729 | 2/1965 | Grant . | |
| 3,171,690 | 3/1965 | Weiss . | |
| 3,221,348 | 12/1965 | Siegel . | |
| 3,632,150 | 1/1972 | Milakovich . | |
| 3,704,911 | 12/1972 | Milakovich . | |
| 3,754,662 | 8/1973 | Prinz | 108/93 X |
| 3,951,453 | 4/1976 | Zapf . | |
| 3,973,798 | 8/1976 | White . | |
| 3,973,800 | 8/1976 | Kogan . | |
| 4,043,591 | 8/1977 | Lehmann . | |
| 4,305,616 | 12/1981 | Martinez . | |
| 4,621,381 | 11/1986 | Schramek . | |
| 4,848,839 | 7/1989 | Galardo . | |
| 4,932,720 | 6/1990 | Sherman | 297/440.16 |
| 4,989,519 | 2/1991 | Welsch et al. | 108/192 |
| 5,026,121 | 6/1991 | Ratalahti | 297/440.16 |
| 5,069,506 | 12/1991 | Wieland . | |
| 5,106,153 | 4/1992 | Durling . | |
| 5,137,332 | 8/1992 | Gualtierotti et al. . | |
| 5,230,105 | 7/1993 | Watson | 297/440.16 X |
| 5,265,939 | 11/1993 | Self et al. . | |
| 5,390,463 | 2/1995 | Sollner | 403/14 X |

FOREIGN PATENT DOCUMENTS

| | | | |
|---|---|---|---|
| 1532516 | 6/1968 | France | 297/440.16 |
| 8402560 | 7/1984 | WIPO | 403/13 |

OTHER PUBLICATIONS

Best Value Ready–to–Assemble flyer.

Article entitled "*Your Guide to Design Protection*" by: Gina E. Donlin UDM Upholstery Design & Manufacturing pp. 18 & 19–Date: Jan. 1994.

Various articles in Furniture/Today Weekly Business Newspaper of the Furniture Industry–Dated Jul. 11, 1994 Article entitled "New RTA uph.Targets Furniture Stores, Alternative Channels"–by: Lee Buchanan Furniture Today –dated Feb. 14, 1994.

Newspaper article entitled "Sofa Designers Piece Together Ideas That Fit Simply for Buyers–News & Record"–dated Apr. 4, 1994.

*Primary Examiner*—Peter R. Brown

*Attorney, Agent, or Firm*—Rhodes, Coats & Bennett, L.L.P.

[57] ABSTRACT

An ready-to-assemble seating structure comprising a seat frame having an upper surface with downwardly extending, tapered sockets therein; a backrest frame having a lower surface with upwardly extending, tapered sockets therein, the sockets in said upper frame member being axially aligned with the sockets in said lower frame member; and a plurality of connector pins having two opposed, outwardly tapered ends, one of which is configured to removably engage aligned sockets in the seat frame and the other of which is configured to removably engage aligned sockets in the backrest frame. The structure may also include arm frames, each having a lower surface with upwardly extending, tapered sockets therein to join the arm frames to the seat frame with additional tapered connector pins.

11 Claims, 4 Drawing Sheets

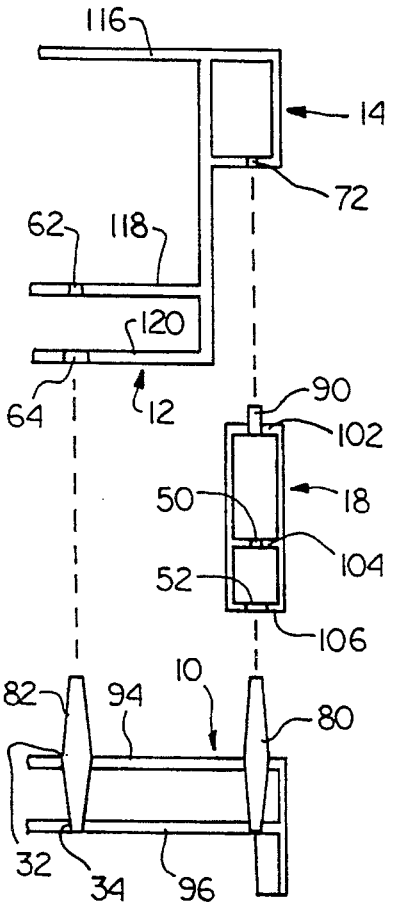
FIG. 3
FIG. 2
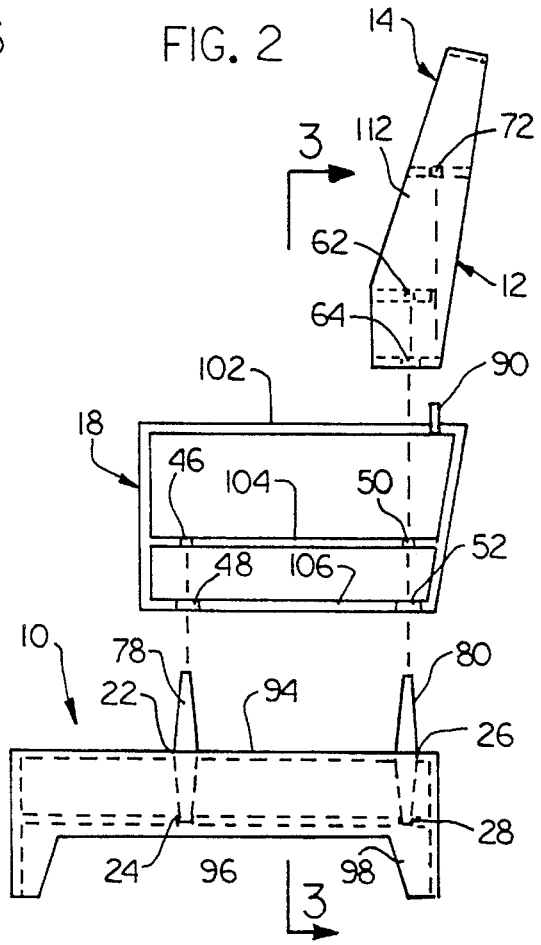
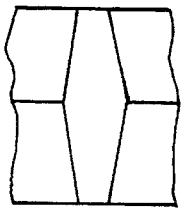
FIG. 4
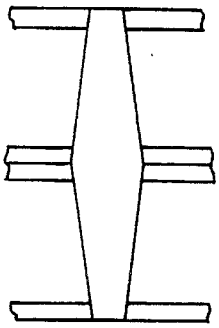
FIG. 5
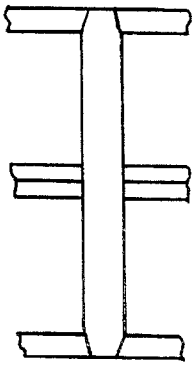
FIG. 6
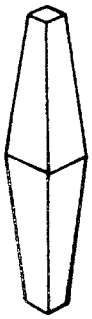
FIG. 7

READY-TO-ASSEMBLE UPHOLSTERED FURNITURE

BACKGROUND OF THE INVENTION

Ready-to-assemble, or knockdown, furniture provides several advantages over fully assembled furniture. For example, ready-to-assemble furniture has reduced volume for shipping; the retailer has greater flexibility in inventorying components, since the customer can mix/match components to get his desired style; the retail customer can also replace a damaged component without replacing the entire unit; and the furniture is more easily moved and stored.

The prior art describes several ready-to-assemble furniture constructions. For example, U.S. Pat. No. 4,621,381 to Schramek describes a knockdown sofa in which downwardly extending tongue pieces on the sofa back and arms are slidably inserted into truncated "V"-shaped openings in the sofa base. The tongue pieces are then bolted to the base for stability.

U.S. Pat. No. 3,704,911 to Milakovich describes a knockdown chair in which bolt heads extending from the inside of the arms are fitted within keyhole slots in the sides of the base. The bolts are then locked into place to prevent the arms from being unintentionally detached. In addition a peg with ratchet teeth extends from the bottom of the backrest into a socket in the seat, and is held in place by a spring loaded ratchet dog.

A similar structure is shown in U.S. Pat. No. 3,632,150 to Milakovich, except that the seat is mounted on the legs by cylindrical pegs extending up from the leg assembly through holes in the seat. A locking mechanism fits into a step-down neck portion on each peg to prevent the pegs from being retracted.

U.S. Pat. No. 3,066,982 to Brower describes a knockdown frame for furniture in which the arms are mounted on the base with bolts which extend upwardly from the legs through base pieces and holes in the lower part of the arms. The back is held in place by a combination of slots in lower extended portions of the back that rest over pegs extending from the base, and projections which extend upwardly from the arms into spaces within extended side members on the back.

U.S. Pat. No. 3,221,348 to Siegel describes a sofa bed in which the back is held in place by a combination of downwardly extending pegs, upwardly extending supports, and bolts. U.S. Pat. No. 4,932,720 describes a sofa bed in which the top is held in place by templates having a rectangular bottom and an angled top, which fix into slots in the base and top. U.S. Pat. No. 2,466,204 to Brown describes a chair in which dowels extend downwardly from the back and arms into bore openings in the base.

The acceptance of ready-to-assemble furniture has been limited by at least one of two disadvantages. First, most prior art structures are difficult for the unskilled homeowner to assemble or disassemble and, require considerable assembly or disassembly time even for the relatively skilled individual. Secondly, prior art assemblies, with the possible exception of some assemblies which use bolts and complex locking arrangements, are less than rigid when assembled, giving the impression of cheapness and instability.

SUMMARY OF THE INVENTION

Unlike prior art furniture constructions, ready-to-assemble furniture made in accordance with the present invention is both easy to assemble and disassemble, and is of a rigid structure when assembled.

Basically, the ready-to-assemble seating structures described herein, which may be a sofa, a chair, a love-seat, or other seating structure, comprises a seat member having an upper surface with a plurality of spaced sockets therein extending downwardly from the surface; a backrest member having a lower surface with a plurality of spaced sockets therein corresponding to sockets in the seat member and extending upwardly from the lower surface; and a plurality of double-ended connector pins which are configured to removably engage opposed sockets in the upper surface of the seat member and the lower surface of the backrest member.

The seating structure may also include one or two arm members which have a lower surface with a plurality of sockets therein extending upwardly from the surface. In structures with arms, the seat member will also including a plurality of sockets therein corresponding to the sockets in the arm member or members, so that connector pins can be inserted within opposed sockets in the arms and the seat to secure the arm members.

In a preferred embodiment, at least a part of the length of the sockets in the structure members are tapered about their periphery in order to maximize stability of the structure. The taper extends away from the outer surface of the member, i.e., the cross-section of the tapered portion of the socket becomes progressively less away from the surface into which the connector pin is inserted. The cross-section of the tapered portion of the socket may be of a variety of shapes, e.g., circular, oval or rectangular, provided that the cross-section diminishes in all directions along the tapered section. For maximum stability, as well as ease of production, the sockets are preferably tapered along their entire length.

The sockets may be formed by molding or drilling a tapered recess into the structural member. A tapered metal or plastic shim may be inserted into the tapered recess for increased durability. Alternatively, the recess may be of uniform cross-section, with a metal or plastic shim having a uniform cross-sectional exterior and an tapered interior inserted into the recess to form the socket. The sockets may extend partly or completely through the structural member. In a preferred embodiment, the sockets are from about ¾ to about 1.5 inches in diameter at its widest dimension and from about ¼ to about 0.5 inch at its narrowest dimension, and from about 3 to about 10 inches in length. Sockets used in different parts of the seating structure may be of different sizes and shapes, although all sockets in a seating structure will preferably be of the same size and shape for ease and economy in manufacture.

The connector pins used the join the structure members have two opposed tapered ends with outer surfaces shaped to conform to the inner walls of the sockets. Thus, each tapered end of the pin tapers inwardly toward the end of the pin, i.e., the cross-section of the pin becomes progressively less toward each of the pin's ends. The cross-section of the tapered portion of the pin should be the same as that of the socket and, like the socket, may be of a variety of shapes, e.g., circular, oval or rectangular. The tapered ends may abut each other at their interior, i.e., widest, ends, or they may be separated by an interior pin segment, which may be of uniform cross-section, e.g., cylindrical.

The connector pins may be formed of any suitable material, such as wood, metal, plastic, or a combination thereof. The diameter of the tapered portion of the pin will be determined by the diameter of the socket into which it is inserted. The length of the tapered portion of the pin should be about equal to the length of the socket.

In one embodiment, the seat member of the seating structure may comprise an upholstered seat frame having an upper frame member with an upper surface, a lower surface, and sockets extending from the upper surface to the lower surface. The sockets in the upper frame may be cylindrical or tapered. The seat frame will also include a lower frame member with an upper surface, a lower surface, and downwardly tapered sockets extending from the upper surface to the lower surface. The lower frame member is positioned generally below the upper frame member and the sockets in the upper frame member are axially aligned with the sockets in said lower frame member.

The seating structure may also include an upholstered backrest frame having a lower frame member with an upper surface, a lower surface, and sockets extending from the lower surface to the upper surface, and a upper frame member with an upper surface, a lower surface, and upwardly tapered sockets extending from the lower surface to the upper surface. The sockets in the lower frame may be cylindrical or tapered. The lower frame member is positioned generally beneath the upper frame member. The sockets in the upper frame member are axially aligned with the sockets in the lower frame member, and with sockets in the upper and lower frame members of the seat frame.

An article of furniture comprising first and second frame member having surfaces with a plurality of sockets therein is assembled with a plurality of removable connectors having opposed ends by placing one end of the connectors in the sockets in said first member, aligning the sockets in the second member in a facing relationship with the sockets in said first member, and placing the opposed ends of the connectors in the sockets in the second member. If the first and second frame members include openings aligned with the sockets, the connector ends are inserted through said openings before insertion into said sockets.

In a preferred embodiment, the backrest frame member is joined to the seat member by inserting one tapered end of a connector pin into a socket in the seat member. Since the shape of the exterior wall of the pin conforms to the shape of the interior wall of the socket, and since the pin section and the socket are tapered, the pin is easily inserted into the socket and is rigidly secured when completed inserted. Also, the taper causes the pin to "find" the most secure engagement by the force of gravity. The opposed tapered section of the pin is similarly inserted into an opposed socket in the backrest member by lowering the backrest frame member onto the lower frame member. Opposed ends of other connector pins are similarly inserted into the other opposed sockets in the seat and back members.

As mentioned earlier, some seating structures within the scope of the present invention may have one or two arms. If so, each arm may be formed of an upholstered arm frame having a lower frame member with an upper surface, a lower surface, and sockets extending from the lower surface to the upper surface. The frame may also have an upper frame member with an upper surface, a lower surface, and upwardly tapered sockets extending from the lower surface to the upper surface. The sockets in said upper frame member are axially aligned with the sockets in the lower frame member, and with sockets in the upper and lower frame members of the seat frame.

In order to provide additional stability in seating structure with arm members, connector pins may also be used to join the arm member or members to the backrest member. In these structures, each arm member may include sockets extending downwardly from an upper surface of each arm member. Opposed sockets may be located in a lower surface of the backrest member. Connector pins will then be inserted into opposed sockets in the arm and backrest members.

For example, the backrest member may include laterally extending ears having a lower surface with upwardly tapering sockets extending from the lower surface. Opposed sockets are located in the upper surface of an upper frame member of an arm member as described above. When assembled, the ears of the backrest will extend over the arm members and will be joined to the arm members with connectors pins extending into opposed sockets in the ears and arm members.

BRIEF DESCRIPTION OF THE DRAWINGS

FIG. 2 is a view of the right end of the frame of a preferred seating structure.

FIG. 3 is a frontal view of the right end of a seating structure along 3—3 in FIG. 2.

FIGS. 4–6 are frontal views of different shaped connector pins having two opposed, tapered end sections with a circular cross-section extending from the center of the pin, joining two seating structure frames.

FIG. 7 is a perspective view of a connector pin with opposed ends in the shape of a truncated pyramid.

DESCRIPTION OF THE PREFERRED EMBODIMENT

Figure 1:
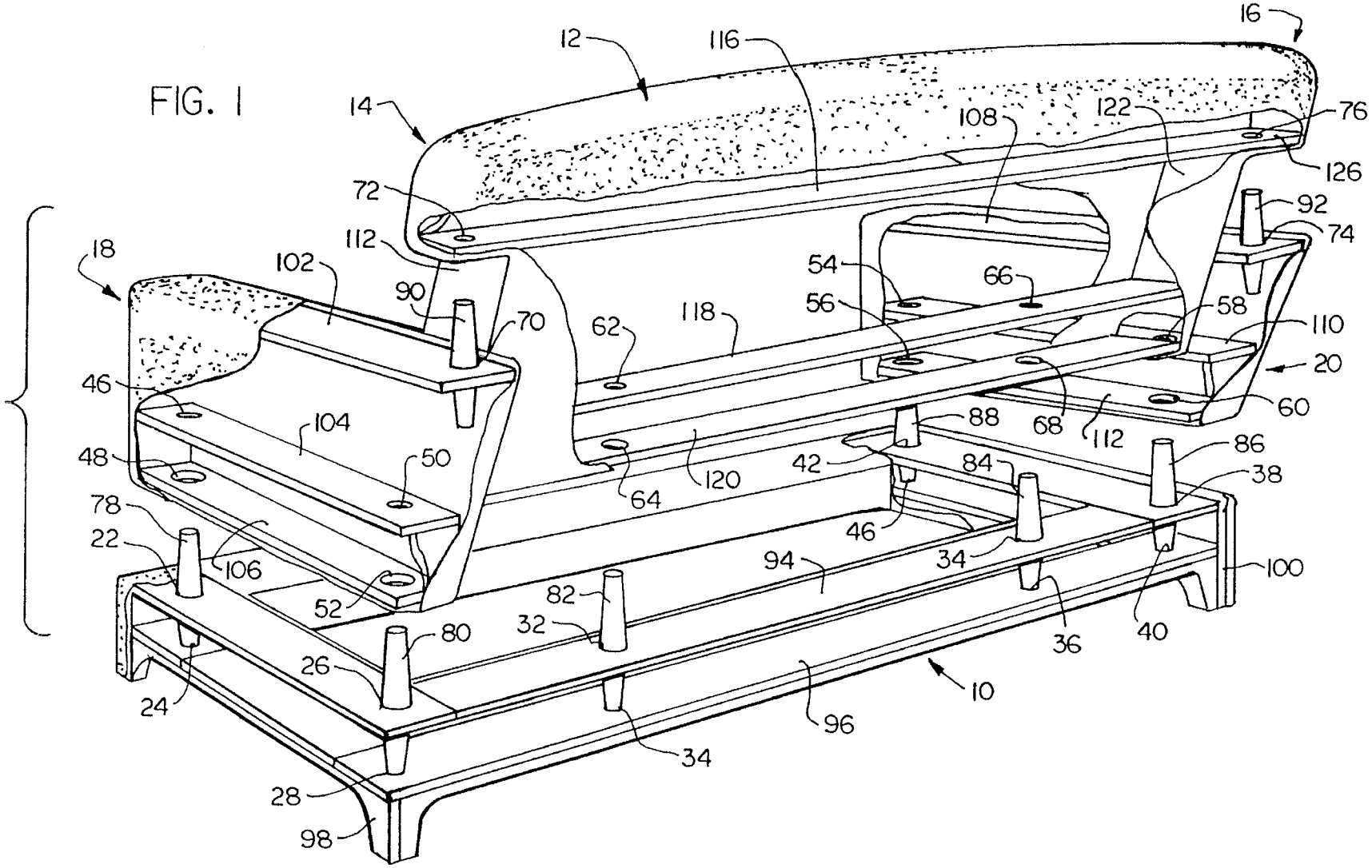
FIG. 1 is a rear perspective view of a ready-to-assemble upholstered seating structure, specifically a sofa, constructed in accordance with the present invention.

As best shown in FIGS. 1–3, the seating structure of the present invention comprises a seat member 10, a backrest member 12 having laterally extending ears 14 and 16, a pair of arm members 18 and 20, and a plurality of sockets 22–76 into which are inserted a plurality of connector pins 78–92.

Seat member 10 comprises an upper horizontal frame member 94 and a lower horizontal frame member 96 spaced from and positioned generally below member 94. Members 94 and 96 are supported at the right end, as viewed from the front, by legged support member 98, and at the left end by an equivalent legged support member 100. Member 94 includes spaced openings 22, 26, 30, 34, 38, and 42 therein, vertically aligned with openings 24, 28, 32, 36, 40, and 44 in horizontal member 96. Removable connector pins 78, 80, 82, 84, 86, and 88 are shown inserted in sockets made up by aligning opening pairs 22/24, 26/28, 30/32, 34/36, 38/40, and 42/44, respectively.

Arm member 18 comprises spaced horizontal members 102, 104 and 106, with member 104 generally below member 102, and member 106 generally below member 104. Supporting vertical members are also provided. Member 104 has two spaced sockets 46 and 50 therein, and member 106 has two spaced openings 48 and 52 vertically aligned with openings 46 and 50,to receive removable connector pins 78 and 80 in socket pairs 46/48 and 50/52, respectively. Horizontal member 102 includes a socket 70 to join arm member 18 to ear 14 of backrest member 12.

Similarly, arm member 20 comprises horizontal members 108, 110 and 112, with member 110 generally beneath member 108 and member 112 generally beneath 110. Supporting vertical members are also provided. Member 110 has two spaced sockets 54 and 56 therein, and member 112 has two spaced openings 58 and 60 vertically aligned with openings 54 and 56, to receive removable connector pins 86 and 88 in socket pairs 54/56 and 58/60, respectively. Horizontal member 108 includes a socket 74 to join arm member 20 to ear 16 of backrest member 12.

Backrest member 12 comprises a side frame member 114, which supports the ends of spaced horizontal frame members 116, 118, and 120. The opposite ends of members 116, 118, and 120 are supported by an opposed side frame member 122. Ear 14 extends from side frame member 114 and includes a lower surface 124 with socket 72 therein aligned with socket 70 in the upper surface of horizontal member 102 forming a part of arm member 18. Similarly, end frame member 122 supports ear 16, which includes a lower surface 126 with a socket 76 therein aligned with socket 74 in the upper surface of horizontal member 108 forming a part of arm member 20. Connector pin 90 is shown inserted into socket 74 and positioned so that its other end can be inserted into socket 76.

In order to assemble a seating structure, connector pin 78 is inserted into opening 22 and opening 24. Connector pins 80-88 are inserted through the other above-noted openings in horizontal member 94, and into the above-noted sockets in horizontal member 96.

Arm member 18 is then positioned above and lowered onto pins 78 and 80, which pass into openings 48 and 52 in horizontal member 106, and then into openings 46 and 50 in horizontal member 104. Similarly, arm member 20 is positioned above and lowered onto pins 86 and 88 which are first inserted through openings 38 and 42 in horizontal member 94, and then into openings 40 and 44 in horizontal member 96.

Pins 90 and 92 are then inserted into sockets 70 and 74, respectively, in the upper surfaces of frame members 102 and 108. Thereafter, backrest member 12 is positioned above and lowered onto pins 82 and 84, so that the pins pass through openings 64 and 68 in horizontal member 120, and then into openings 62 and 66 in horizontal member 118. At the same time, pins 90 and 92 pass sockets 72 and 76 in lower surfaces 124 and 126, respectively, of ears 14 and 16. The assembly is then complete, producing a sofa which is rigid, but easily disassembled. The assembly process can be quite rapid, taking only a minute in many cases. Additional cushions can be placed on the sofa, if desired.

It will be apparent that various shapes of pins can be employed for the above-described purpose. For example, FIG. 4 shows a pin having opposed tapered ends extending from the center of the pin. FIG. 5 shows a pin having longer tapered sections, but still extending from the center of the pin. This type of pin could be used as in the above preferred embodiment to join two frame member, each including first and second vertically spaced frame parts. Alternatively, if less rigidity was required, this type of framework could be joined with a pin of the type shown in FIG. 6, which comprises a central cylindrical section and two opposed outer tapered sections with their inner ends integral with the central section. The use of tapered pins in tapered sockets helps assure rigidity as the force of gravity action on the backrest 14 and arms 18 and 20 urge the pins into intimate engagement with their respective sockets. Also, the tapered shape permits this result, even if manufacturing tolerances are not particularly precise.

Figure 8:
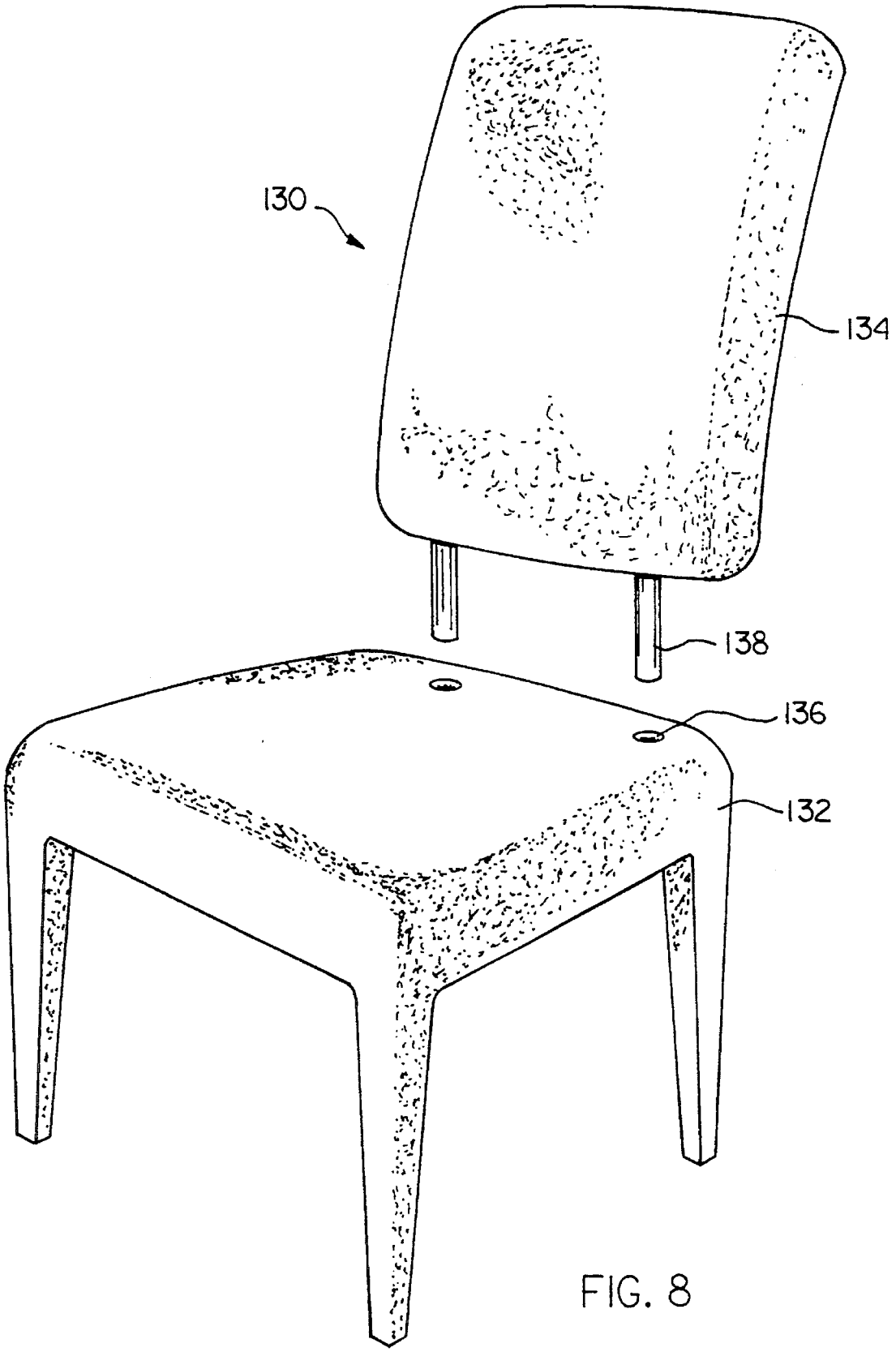
FIG. 8 is a side view-of a chair embodiment.

FIG. 8 shows the invention carried out in the form of a chair 130. The chair 130 has a base unit 132 and a backrest unit 134. The base unit 132 has sockets 136 just like the sockets mentioned previously. The backrest unit also has sockets (not shown) in which pins 138 like the pins described earlier have been inserted. The backrest is mounted on the base unit by inserting the pins 138 in the sockets in the backrest and then lowering the backrest onto the base unit while inserting the pins 138 into the sockets 136. Of course, the pins can be loaded into the base unit first, with the backrest unit lowered onto the positioned pins, if desired.

Figure 9:
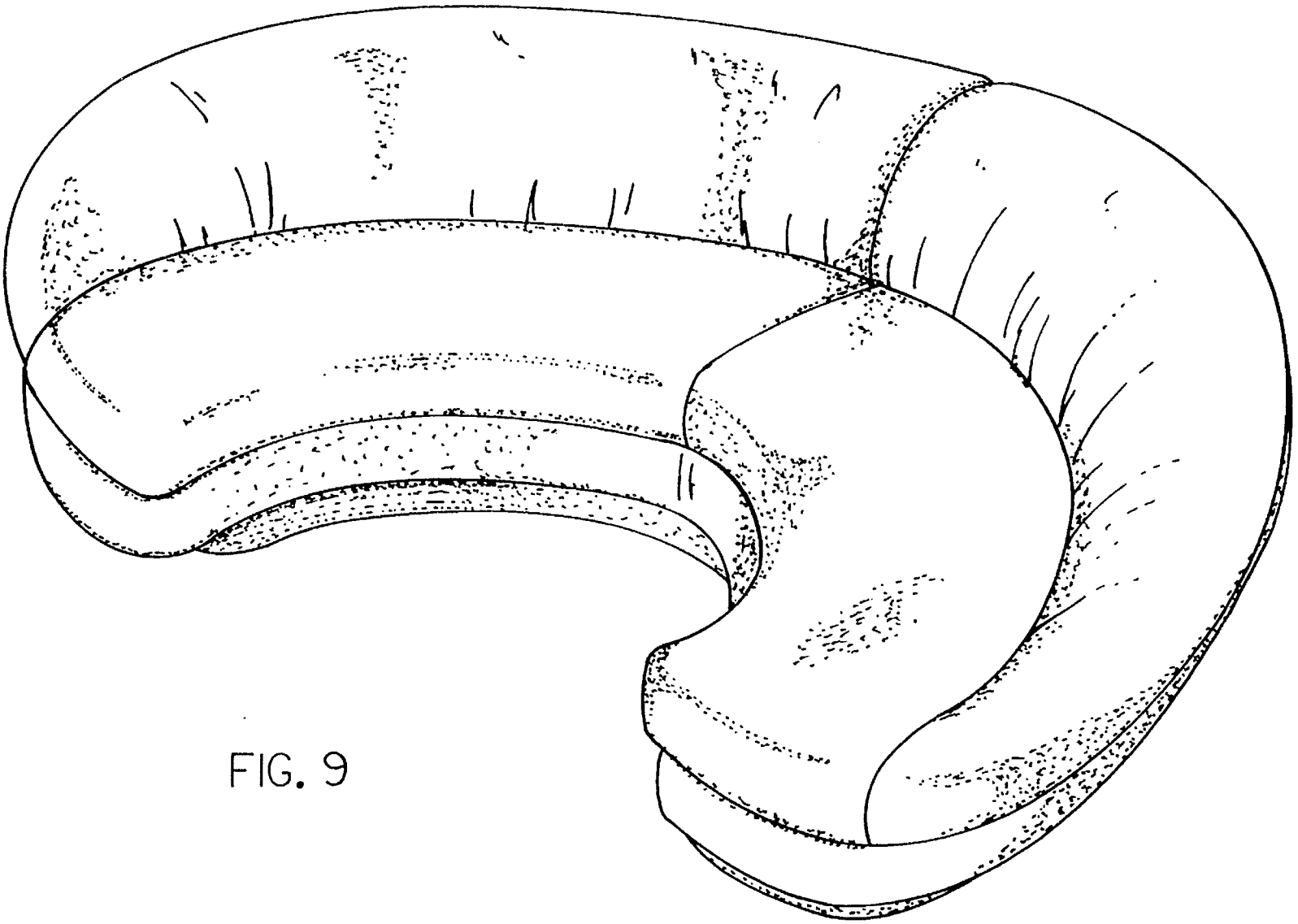
FIG. 9 is a perspective view of an alternate sofa embodiment.

Certain modifications and improvements will occur to those skilled in the art upon a reading of the foregoing description. By way of example, the back or arms of the seating structure can be curved, as seen in FIG. 9, instead of straight. Also, the shape of the seat, arm and backrest members can be different from that shown. A greater or lesser number of sockets and pins can also be used. It should be understood that all such modifications and improvements have been deleted herein for the sake of conciseness and readability but are properly within the scope of the following claims.

What is claimed is:

1. A ready-to-assemble seating structure comprising:

(a) a seat frame having an upper seat frame member with an upper surface, a lower surface, and downwardly tapered sockets extending from said upper surface to said lower surface, and a lower seat frame member with an upper surface, a lower surface, and downwardly tapered sockets extending from said upper surface to said lower surface, the sockets in said upper seat frame member being axially aligned with the sockets in said lower seat frame member;

(b) a backrest frame having a lower backrest frame member with an upper surface, a lower surface, and upwardly tapered sockets extending from said lower surface to said upper surface, and a upper backrest frame member with an upper surface, a lower surface, and upwardly tapered sockets extending from said lower surface to said upper surface, the sockets in said upper backrest frame member being axially aligned with the sockets in said lower backrest frame member, and with sockets in the upper and lower seat frame members; and (c) a plurality of connectors having two opposed, outwardly tapered ends, one of which is configured to removably engage aligned sockets in said seat frame and the other of which is configured to removably engage aligned sockets in said backrest frame.

2. The article of claim 1, further comprising first and second arm frames, each of said frames having a lower arm frame member with an upper surface, a lower surface, and upwardly tapered sockets extending from said lower surface to said upper surface, and an upper arm frame member with an upper surface, a lower surface, and upwardly tapered sockets extending from said lower surface to said upper surface; additional sockets in said seat frame; and additional connectors for said additional sockets; the sockets in said upper arm frame member being axially aligned with the sockets in said lower arm frame member, and with sockets in the upper and lower seat frame members, said additional connectors being configured to removably engage aligned sockets in said arm and seat frame.

3. The article of claim 1, wherein the tapered ends of said connectors are frusto-conical.

4. The article of claim 1, wherein the tapered ends of said connectors are in the shape of a truncated pyramid.

5. The article of claim 1, wherein the sockets in said upper and lower frame members have aligned walls.

6. A modular furniture structure comprising:

a) a plurality of removable connecting pins having a center and opposed tapered ends extending from said center, b) a seat member having an upper surface, said surface including a plurality of tapered openings, c) a first arm member having a lower surface with at least one tapered opening and an upper surface with at least one tapered opening, said first arm member being detachably connected to said seat member by at least one of said removable connecting pins vertically disposed within a tapered opening in said seat member and a tapered opening in said first arm member, and d) a back rest member having a lower surface including a plurality of tapered openings and a first laterally extending ear, said ear having a lower tapered opening, said back rest member being detachably connected to said seat member and said first arm rest member by one of said removable connecting pins vertically disposed within a tapered opening in said seat member and at least one removable connecting pin vertically disposed within said tapered opening in said first arm member upper surface and said lower tapered opening in said ear of said back rest.

7. The article of claim 6, wherein said tapered openings are tapered from said surfaces of said members into said members.

8. The article of claim 6, wherein said connecting pins have two opposed, frusto-conical ends.

9. The article of claim 6, wherein said seat and backrest members are upholstered.

10. The sofa of claim 6, wherein said openings are tapered inwardly from said surfaces, and said connecting pins have opposed, outwardly tapered ends.

11. The sofa of claim 6, wherein said openings and said tapered ends of said connectings pins are conical.

* * * * *